US007357251B2

(12) United States Patent
Vosloo et al.

(10) Patent No.: US 7,357,251 B2
(45) Date of Patent: Apr. 15, 2008

(54) TOP CUFF WITH DIVIDERS FOR GOLF BAGS

(75) Inventors: Clint Vosloo, Suwanee, GA (US); Andreas Kikidas, Cobham (GB)

(73) Assignee: Mizuno Corporation, Osaka (JP)

( * ) Notice: Subject to any disclaimer, the term of this patent is extended or adjusted under 35 U.S.C. 154(b) by 127 days.

(21) Appl. No.: 11/200,850

(22) Filed: Aug. 10, 2005

(65) Prior Publication Data

US 2007/0045139 A1 Mar. 1, 2007

(51) Int. Cl.
*A63B 55/00* (2006.01)
*A63B 55/04* (2006.01)
*A63B 55/06* (2006.01)

(52) U.S. Cl. ..... 206/315.6; 206/315.3; 211/70.3

(58) Field of Classification Search ..... 206/315.3, 206/315.6, 315.2; 280/DIG. 6; D3/318, D3/320; 211/70.2; 248/96
See application file for complete search history.

(56) References Cited

U.S. PATENT DOCUMENTS 5,125,507 A * 6/1992 Graziano, Jr. ..... 206/315.6
5,671,842 A * 9/1997 Jaworski ..... 206/315.3
5,671,843 A * 9/1997 Sutter ..... 206/315.6
5,725,095 A * 3/1998 Beck et al. ..... 206/315.8
6,564,936 B1 * 5/2003 Campbell ..... 206/315.6
D478,422 S * 8/2003 Chen ..... D3/320
6,726,009 B1 * 4/2004 Larson et al. ..... 206/315.6
7,014,040 B2 * 3/2006 Anderson et al. ..... 206/315.6
2002/0189962 A1 * 12/2002 Chen ..... 206/315.7
2005/0092630 A1 * 5/2005 Chen ..... 206/315.6
2005/0115851 A1 * 6/2005 Kadoya ..... 206/315.6

* cited by examiner

*Primary Examiner*—Sue A. Weaver
(74) *Attorney, Agent, or Firm*—Troutman Sanders LLP; James E. Schutz; James Hunt Yancey, Jr.

(57) ABSTRACT

A top cuff for a golf bag that has an outer collar and two sets of arcuate dividers. The first set of arcuate dividers may be angled in a first downward direction relative to the top of the top cuff. The second set of arcuate dividers are angled in a downward direction that is opposite from the downward angled direction of the first set of arcuate dividers. Each arcuate divider from the second set intersects at least one arcuate divider from the first set of arcuate dividers along a central axis extending vertically through the top cuff. The downward angled direction of each of the arcuate dividers allows golf clubs, when placed within each compartment, to be carried away from the central portion of the top cuff and come to rest near the outer collar, thereby minimizing contact between golf clubs.

17 Claims, 13 Drawing Sheets

TOP CUFF WITH DIVIDERS FOR GOLF BAGS

TECHNICAL DESCRIPTION OF THE INVENTION

The present invention is directed to golf bags and more particularly to top cuff for golf bags.

BACKGROUND

Golf club designers are constructing golf clubs, especially metal wood golf clubs, with space-age materials, such as aircraft-grade aluminum, titanium, carbon fiber composites, metal alloys, and the like to increase the performance of the golf club and make it easier for the average golfer to hit. However, the use of these space-age materials has lead to an increase in the price of golf clubs, which may exceed $500 or more for a single golf club. For many golfers, these clubs are more than sports equipment, they are an investment. Unfortunately, most golf bags perform poorly in protecting these expensive golf clubs. For instance, golf bags have traditionally used top cuffs with two dividers to partition the golf bag into three individual compartments. The compartments allow the golf clubs to shift back and forth and strike one another causing nicks, scratches, and dents in both the club heads and the golf shafts. Furthermore, these dividers allow the shorter golf clubs to strike the longer golf clubs around the hosel area, which may damage the club head or the shaft of the longer golf clubs. This is especially critical for golf clubs using composite shafts that have coatings that may be easily damaged.

This problem may be further exacerbated if the golf bag is carried. When the golf bag is placed over the shoulder of the golfer, the bag may be canted, or tilted to one side as it rests against the golfer's body. The tilting of the golf bag may result in most, if not all, of the clubs shifting to one side of the golf bag, which results in the golf clubs being in constant contact with one another for prolonged periods of time, thereby increasing the amount of damage to the individual golf clubs.

Several approaches have attempted to address these problems. One approach has been to provide the top cuff with a vertical divider located along a central axis and a pair of cross dividers. In some instances, the vertical divider extended between the pair of cross dividers to create four separate compartments, while in other instances, the vertical divider extended across the entire top cuff to create six separate compartments. Both of these configurations served to separate the golf clubs from one another. Additionally, the dividers may have been covered in a soft cloth or fabric to protect the expensive composite shafts from excessive wear. However, the golf clubs within one compartment can still move around and collide with other golf clubs within the same compartment and adjacent compartments. Furthermore, the dividers typically lie below or even with the level of the top cuff, which allows the shorter golf clubs to come in contact with and damage the shaft and hosel area of longer golf clubs.

A second approach to solve the problem includes several methods for separating the top cuff into 14 individual compartments, with each compartment designed to hold a single golf club. One 14-way top cuff design includes placing 14 individual elongated tubes within the golf bag, such that each tube held a single golf club.

Another 14-way top cuff design includes using a number of straight members oriented parallel to one another and attached to opposite end of the top cuff and a number of curved members oriented substantially perpendicular to the straight members. The intersection of the straight and curved members create fourteen individual compartments, which are capable of holding a single golf club. Although the intersecting member created individual compartments, which separated the individual golf clubs and provided protection to the shafts. Although both methods separate the individual golf clubs, the iron golf clubs can still shift within the golf bag and bump into one another. In addition, the top of the tubes typically rest below the level of the top cuff, thereby allowing the heads of the shorter golf clubs to strike the shaft and hosel area of longer golf clubs.

Yet another attempt included a golf club holder insert that fit within the opening of a golf bag that includes a primary holding compartment and a number of secondary holding compartments. The primary holding compartment is typically cylindrical in nature and extends above the secondary holding compartments to separate the longer golf clubs from the shorter golf clubs. The primary holding compartment separates the longer clubs from the shorter golf clubs, which may be stored in the secondary compartments to protect shaft and hosel of the longer golf clubs from damage, which may be caused by contact with the clubs stored in the secondary compartment.

The current top cuffs are typically made from a composite material and have a wall that extends several inches into the interior of the golf bag to provide rigidity to the open end of the golf bag. The wall of the top cuff also provides a point for attaching folding legs for stand-type golf bags. There are two primary types of carts a golfer may use to transport his or her golf bag: a hand trolley or a motorized golf cart. In both circumstances, the golf bag rests upon a support structure, while the top cuff rests against an upper support and is secured by a strap assembly. However, when the stand-type golf bags are placed on either a hand trolley or a motorized golf cart, the folding legs are pressed against the upper support, which may damage folding legs, and render the stand-type golf bag useless.

Therefore, there is a continuing need for an improved top cuff design for a golf bag. In particular, there is a need for a top cuff for a golf bag that minimizes the contact between individual golf clubs that are placed in the golf bag. There is an additional need for a top cuff for stand-type golf bags that may eliminate the contact of the folding legs of the stand mechanism with the support structures of the a hand trolley or motorized golf cart.

SUMMARY OF THE INVENTION

The present invention meets the needs described above in a top cuff for golf bag. Generally described, the invention includes a top cuff for a golf bag that has an outer collar and a series of internal dividers. The outer collar may be generally oval in shape and contains a top edge and a sidewall that extends around the entire circumference of the outer collar. The sidewall may extend below the top edge by several inches to provide a rigid support for the open end of the golf bag. The top cuff also contains two sets of arcuate dividers, which are interconnected to form a series of compartments for holding and separating golf clubs. The first set of arcuate dividers may be angled in a first downward direction relative to the top of the top cuff. The second set of arcuate dividers are angled in a downward direction that is opposite from the downward angled direction of the first set of arcuate dividers. Each arcuate divider from the second set intersects at least one arcuate divider from the first set of arcuate dividers along a central axis extending vertically through the top cuff. The downward angled direction of each of the arcuate dividers allows golf clubs, when placed within each compartment, to be carried away from the central portion of the top cuff and come to rest proximate to the outer collar, thereby minimizing contact between golf clubs.

In addition, at least one of the first arcuate dividers has a height that extends over the top edge of the outer collar and is attached between opposite sides of the outer collar to create a top compartment and a bottom compartment. The top compartment may be used for holding metal wood golf clubs, while the bottom compartment may be use for holding iron golf clubs. The extended height of first divider protects the metal wood shafts from the iron golf clubs in the bottom compartment.

Additionally, the top cuff may also contain a depression in the outer collar, which is offset from the central axis and located between two dividers from the first set of arcuate dividers. A divider from the second set of arcuate dividers may then be connected between the two dividers from the first set of arcuate dividers to form a compartment adjacent to the depression for holding a putter.

The sidewall of the outer collar may be also have a predefined depth that extending below the top edge for the entire circumference of the top cuff and operable for being used in a stand-type golf bag. The legs of the stand-type golf bag may be attached to the sidewall on the backside of the top cuff.

The sidewall of the outer collar may also be divided into a front portion and a back portion, wherein the front portion has a first predefined height and the back portion has a second predefined height, such that the second predefined height of the back portion is lower than the first predefined height of the front portion.

The various aspects of the present invention may be more clearly understood and appreciated from a review of the following detailed description of the disclosed embodiments and by reference to the appended drawings and claims.

DETAILED DESCRIPTION OF THE EMBODIMENTS

Figure 1:
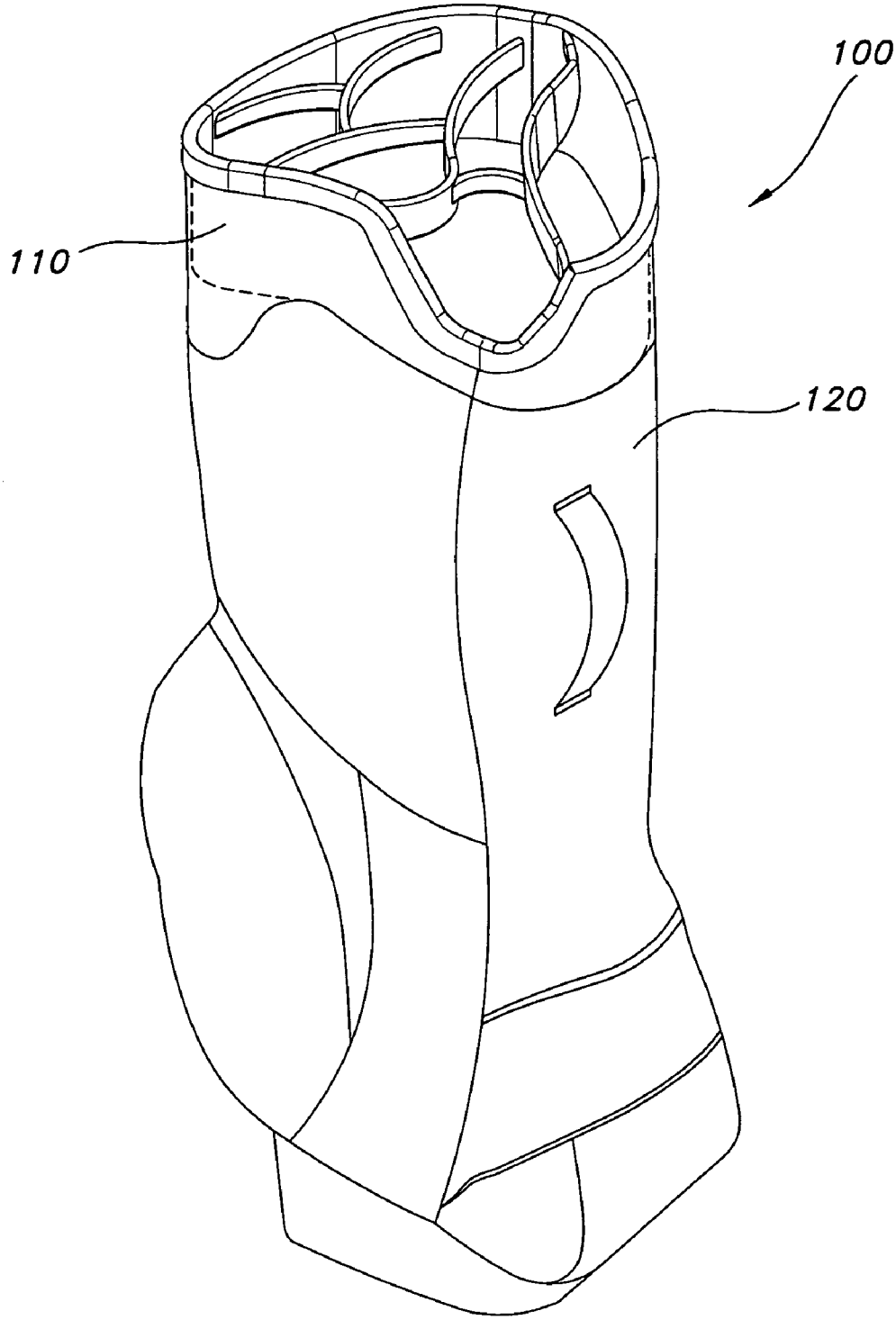
FIG. 1 is an illustration of a golf bag using a top cuff in accordance with some embodiments of the present invention.

Turning to the figures, in which like numerals refer to like elements through the several figures, FIG. 1 is an illustration of a golf bag 100 in accordance with some embodiments of the present invention. The golf bag 100 includes a generally tubular body 120 that has a closed end and an open end. A top cuff 110 is attached to the open end of the tubular body 110 and is disposed for receiving golf clubs, including metal-wood golf clubs, hybrid-type golf clubs, iron golf clubs, and a putter. The golf bag 100 is typically cylindrical in shape and typically includes a handle and several pockets. The golf bag 100 may also contain a rigid support structure (not shown), which is well known in the art, to maintain the structure of the golf bag 100.

Figure 2:
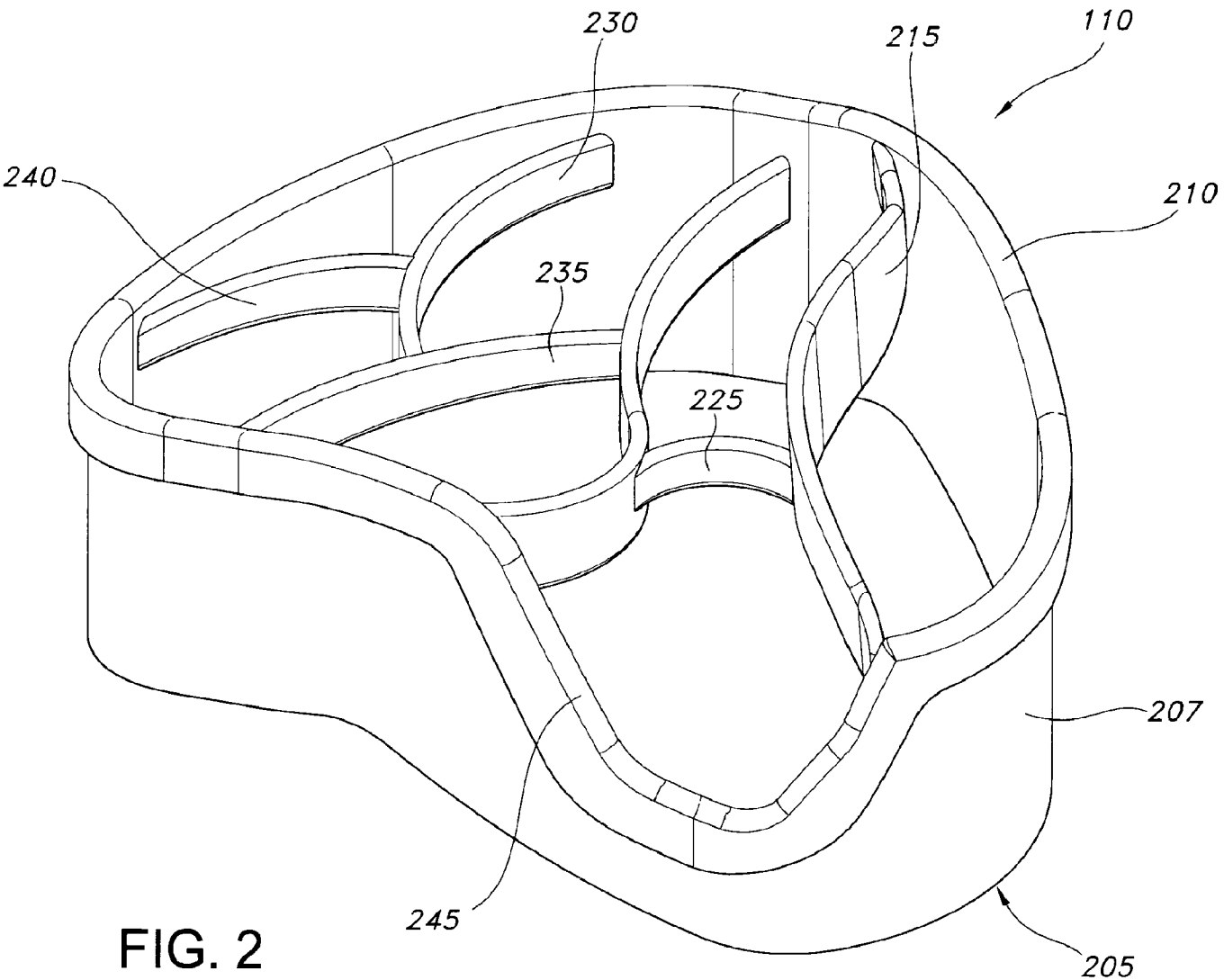
FIG. 2 is an illustration of an isometric view of a top cuff for a golf bag in accordance with an exemplary embodiment of the present invention.

FIG. 2 is an illustration of an isometric view of the top cuff 110 in accordance with some embodiments of the present invention. The top cuff 110 may include a peripheral outer collar 205 that has an outer wall 207 and a top edge 210. The outer wall 207 may have a height in the range of approximately eight (8) to ten (10) centimeters. In some embodiments, the outer collar 205 may be generally oval in shape. However, those skilled in the art will appreciate that other shapes, such as a circle, an ellipse, and the like may be used without departing from the scope of the invention.

The top cuff 110 may also include a first set of arcuate dividers that includes a first arcuate member 215, a second arcuate member 220, and a third arcuate member 230. The first arcuate member 215 has a first end and a second end which are connected on opposite sides of the outer collar 205. The second arcuate member 220 also has a first end and a second end that are connected on opposites sides of the outer collar 205, while the third arcuate member 230 has a first end and a second end, with at least one end connected to the outer collar 205. The first arcuate member 215, the second member 220, and the third member 230 may be oriented in within the outer collar 205 so that they generally lie parallel to one another and are angled in a downward fashion in a first direction.

The top cuff 110 may also contain a second series of arcuate dividers that include a fourth arcuate member 225, a fifth arcuate member 235, and a sixth arcuate member 240. The fourth arcuate member 225, the fifth arcuate member 235, and the sixth arcuate member 240 each have at least one end that that intersect the set of first arcuate dividers at points located along a cente line (C/L) and extend in a generally downward fashion. The fourth arcuate member 225, the fifth arcuate member 235, and the sixth arcuate member 240 are also oriented within the outer collar 205, such that they are angled in a generally downward fashion in a second direction that is opposite from the first direction of the first set of arcuate dividers. The intersection of the first set of arcuate members and the second set of arcuate members form a set of apertures for accepting golf clubs.

The outer collar 205 may also include a depression 245 that may be located adjacent to the central axis C/L that passes vertically through the outer collar 205. The top of the depression 245 may be below the height of the top edge 210 of the rest of the outer collar 205. In some embodiments, the outer collar 205 may be generally elliptical in shape and be defined by a top portion 206, a bottom portion 208 a left side portion 212, and a right side portion 214.

The top cuff 110, including the outer collar 205, the top line 210 and the arcuate dividers 215, 220, 230, 225, 235, and 240 are all constructed of a high impact thermoplastic material, which is both strong and light weight Those skilled in the art will appreciate that other material, such as polymers, composites, including but not limited to carbon composites and graphite composites, light weight metal alloys, ceramics, and the like may be used to form the top cuff 110, including the outer collar 205, the top line 210 and the arcuate dividers 215, 220, 230, 225, 235, and 240 without departing from the scope of the invention.

Figure 3:
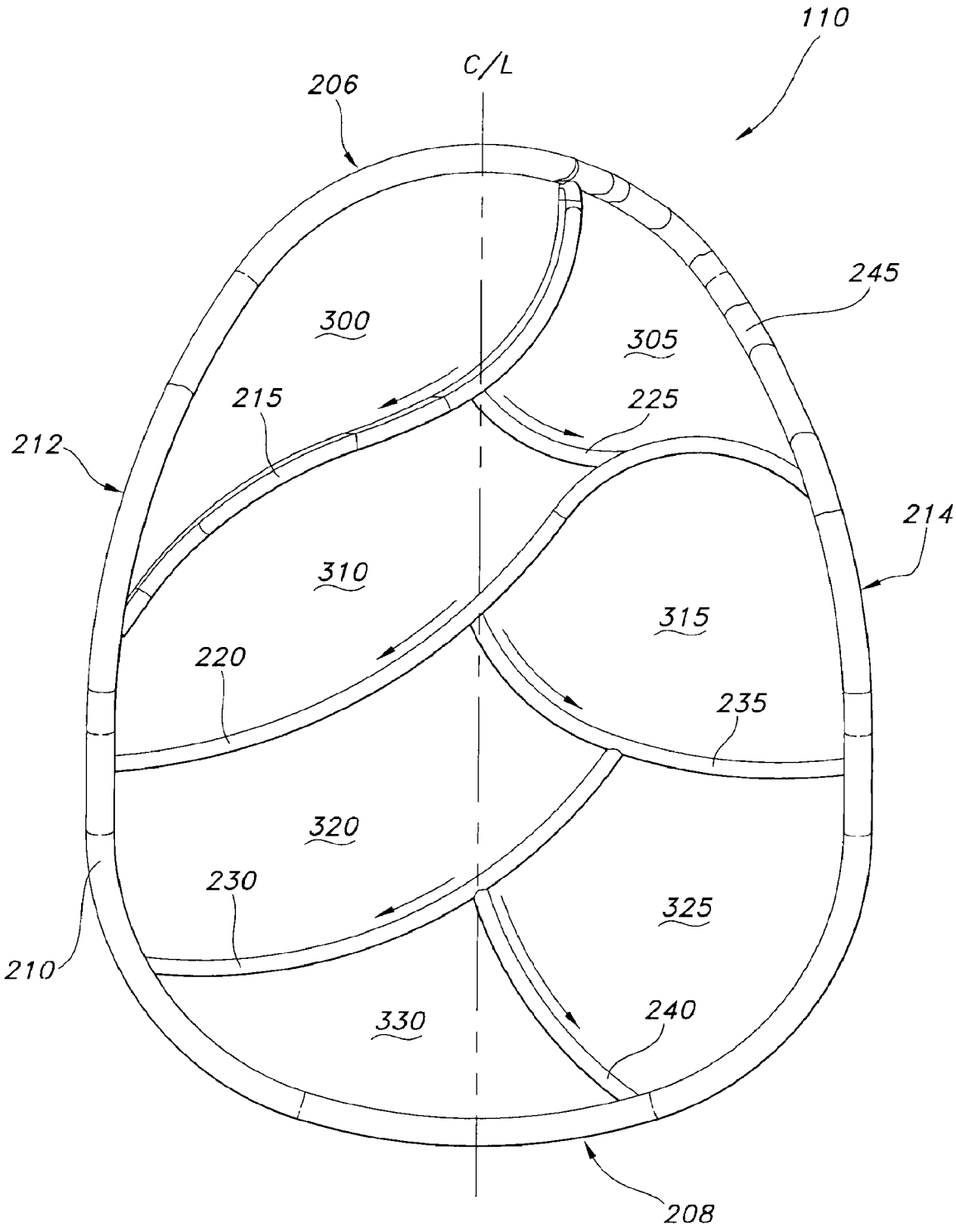
FIG. 3 is an illustration of a top view of a top cuff for a golf bag in accordance with an exemplary embodiment of the present invention.

FIG. 3 is an illustration of a top plan view of one embodiment of the top cuff 110 in accordance with some embodiments of the present invention. The top cuff 110 includes the outer collar 205, which is symmetric about a center line (C/L) that extends vertically through the top cuff 110 and divides the top cuff 110 into a left-side portion and a right-side portion. In one exemplary embodiment of the present invention, the first arcuate member 215, the second arcuate member 220, and the third arcuate member 230 are generally parallel to one another and are angled in a downward direction from the right portion to the left portion. Although the first arcuate member 215, the second arcuate member 220, and the third arcuate member 230 are described as extending in a downward direction from the right portion to the left portion of the top cuff 110, those skilled in the art will appreciate that the first member 215, the second member 220, and the third member 230 may be angled in a downward direction from the left portion to the right portion, or in any other direction, without departing form the scope of the invention.

The first arcuate member 215 may connected to and extending between opposite sides of the outer collar 205. The first arcuate member 215 may be angled in a downward first direction from right to left across the central axis and forms a compartment 300. For example, the first arcuate member 215 may have a first end connected to a point on the right side of the outer collar 205 and extending downward to a point on the left portion of the outer collar 205. The second member 220, is typically oriented in a substantially parallel configuration to the first member 215, and is also connected to and extending between opposite sides of the outer collar 205. The fourth arcuate member 225 has a first end that interconnects the first arcuate member 215 at a point along the center line C/L, then extends downward in a generally left-to-right direction and terminates at a second end that intersects the second arcuate member 220 to form compartments 305 and 310. The compartment 305 may be smaller in size than compartments 300 and 310 and may be used for holding a specialty club, such as a wedge or a putter.

The fifth arcuate member 235 has a first end, which intersect the second arcuate member 220 at a point located along the central axis and extends downward in a left-to-right direction and has a second end connected to the outer collar 205. The combination of the second arcuate member 220 and the fifth arcuate member 235 form a compartment 315. The fifth arcuate member 235 is oriented approximately parallel to the fourth arcuate member 225.

Still referring to FIG. 3, the third arcuate member 220 has a first end, which is connected to the outer collar 205 and extends in an upwardly left-to-right direction and has a second end that intersect the fifth arcuate member 235 at a point intermediate to its ends to form compartment 320. The third arcuate member 230 is oriented approximately parallel to the second arcuate element 220. Finally, the sixth arcuate member 240 has a first end that intersect the third arcuate member 230 at a point intermediate to it ends along the center line (C/L). The sixth arcuate member 240 then extends downward in a left-to-right direction and terminates with its second end being connected to the outer collar 205. The intersection of the third arcuate member 230 with the sixth arcuate member 240 forms the compartments 325 and 330.

The advantage of the present invention is readily apparent from FIG. 3. The arcuate members form a framework of downwardly sloping arcuate dividers, which emanate from a central axis. Therefore, when golf clubs are inserted into any of the compartments, 300, 305, 310, 315, 320, 325, or 330, the golf clubs will be directed along the arcuate members toward the outer collar 205 and away from the central portion of the top cuff 110, as indicated by the arrows. Since the golf clubs are directed away from the central portion of the top cuff 110, the distance between the golf clubs while stored in the golf bag 100 is maximized. Thus, the interaction between golf clubs in the golf bag 100 will be minimized, which minimizes the damage that may occur to the golf club heads and shafts.

In order to further minimize the damage to the golf club head and golf shafts, the entire top cuff 110 may also include a cover. The cover may be made of a fabric material and/or a foam padding material. For example, the cover may be made of velour, which is attached to a protective core made of suitable foam material. The cover may be made from a single piece of fabric, or preferably the cover may be made from several smaller sections that encase each arcuate member. For instance, The fabric and foam materials may be wrapped around the individual arcuate members and the outer collar 205.

Figure 4:
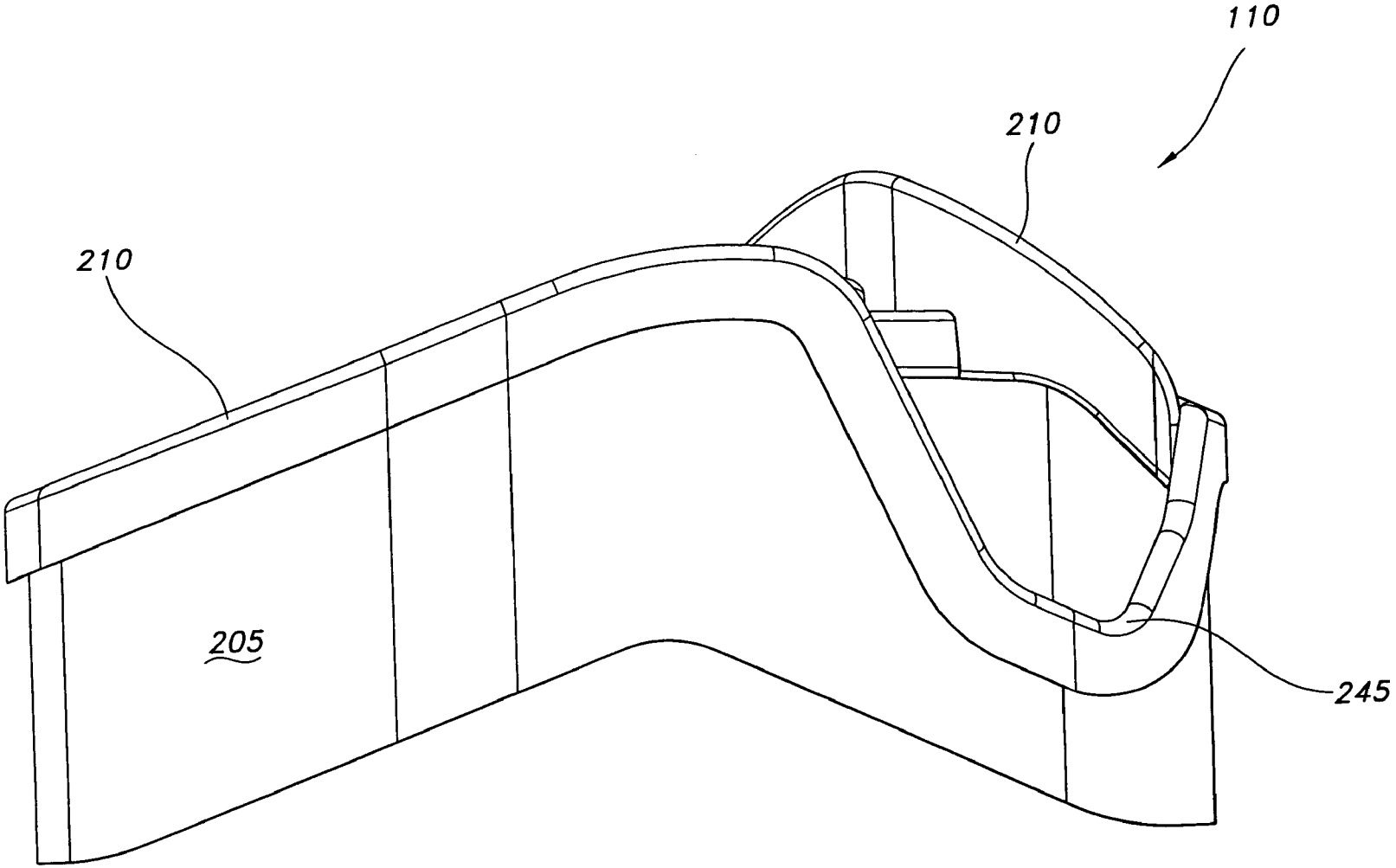
FIG. 4 is an illustration of a side view of a top cuff for a golf bag in accordance with an exemplary embodiment of the present invention.

FIG. 4 is an illustration of a side view of the top cuff 110 in accordance with some embodiments of the present invention. The outer collar 205 and the top line 210 are angled upward to a peak, which lies intermediate between the front and rear of the top cuff 100. The angled peak provides several advantages. First, the compartments 320, 325, and 330, which are positioned rearward of the peak, also lie below the level of the peak. This allows the shorter golf clubs, such as short irons and wedges to be easily inserted or retrieved from these compartments. Secondly, by placing the access points of the rearward compartments 320, 325, and 330 below the level of the peak insures that the golf club heads of the irons remain above the level of the top line 210. This insures that in addition to allowing the shorter golf clubs to be readily accessible, it also insures that the golf clubs contact the arcuate dividers of the top cuff 110 at a point near where the golf shaft joins the golf club head. This allows the golf clubs to lay properly within the compartments 320, 325, and 330 so that they are readily directed away from the central portion of the top cuff 110 to minimize contact with the other clubs in the golf bag 100.

Referring still to FIG. 4, the first arcuate member 215, which defines compartment 300, has a height that lies above the peak of the top cuff 100. Compartment 300 is typically designed to hold longer golf clubs, such as metal woods, long iron golf clubs, and long putters. These golf clubs may range in length from approximately 40 inches up to approximately 54 inches or more, which makes their golf shafts susceptible to damage from the movement of the other clubs. The extended height of the first arcuate member 215 extends up the shaft of the longer golf clubs and prevents the head portion of the shorter iron golf clubs in the remaining compartments from striking the golf shafts of the longer golf clubs stored in compartment 300.

The depression 245, which is offset from the center line (C/L) may be located proximate to the compartment 305. The depression 245 is angled sharply downward from the peak with the bottom of the depression lying significantly below the height of the peak. The sharp downward angle of the depression provides an enlarged opening, thereby making the compartment 305, readily accessible. The large aperture associated with the compartment 305 also allows for the storage of oversized-headed golf clubs, such as oversized-headed putters to be easily inserted and removed from the compartment 305 while minimizing contact the oversized-heeded golf club may have with the surrounding golf clubs.

Figure 5:
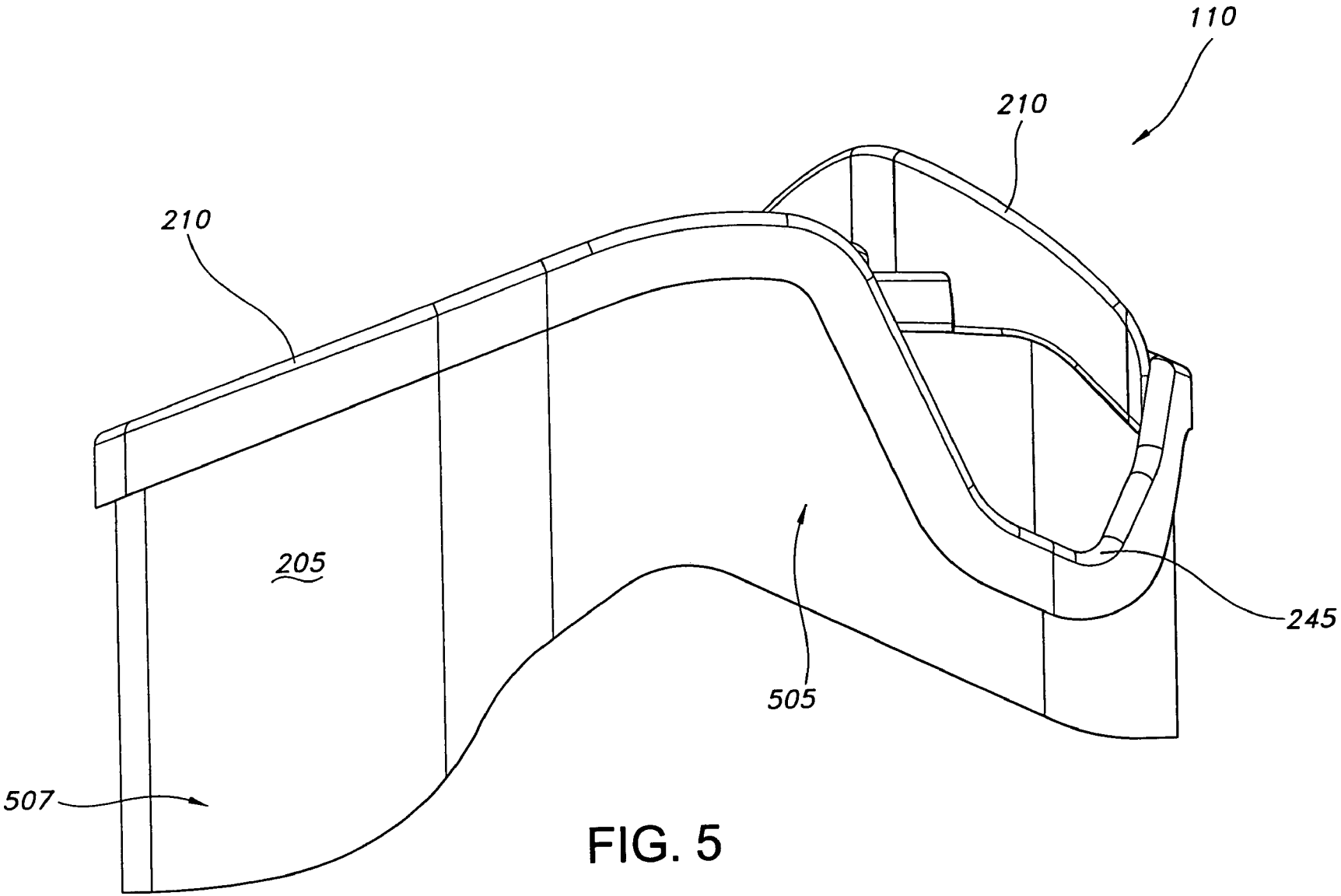
FIG. 5 is an illustration of another exemplary embodiment of side view of a top cuff for use in a stand-type golf bag in accordance with the present invention.

FIG. 5 is an illustration of an alternative embodiment of the side view of the top cuff 110. The top cuff 110 is identical to the top cuff 110 except that rear portion of the outer collar 205 extends several centimeters below the front portion of the outer collar 205. The retractable legs (not show) may be connected to the outer collar 205 through a pivot mechanism (not shown), which is well known in the art. The pivot mechanism is attached to the rear portion of the outer collar 205 by a fastener, such as a bolt, screw, rivet, or any other suitable fastener. Alternatively, the pivot mechanism may be integrated with the rear portion of the outer collar 205. The added length to the rear portion of the outer collar 205 allows the pivot mechanism for the retractable legs (not shown) of the carry golf bag to be attached several inches lower from the top of the top cuff 110 than on a conventional carry bag. Positioning the pivot mechanisms lower down form the top line of the 210 allows the carry bag to be used on both a riding cart and on a hand trolley or pull cart without the pivot mechanisms or the retractable legs resting on the top support of the riding cart or the hand trolley. For example, when a conventional carry bag is placed on a riding cart, the top support that holds the golf bag in place is typically set a predetermined height so that the outer collar 205 of the golf bag rests on the upper support. However, since the pivot mechanism of a carry bag is typically located on the outer collar of the golf bag, the pivot mechanism is placed in direct contact with the top support of the motorized cart. This places an excessive amount of pressure on the pivot mechanism, which may damage the pivot mechanism and or retractable support legs.

However, with a trolley, or pull cart, the top rest is positioned at a predetermined distance from the bottom rest so that the golf bag is supported by the top rest at a point below the top collar. Unfortunately, this places most of the weight of the golf bag at the top rest on the retractable legs. The increased pressure on the retractable legs may damage them.

Figure 12:
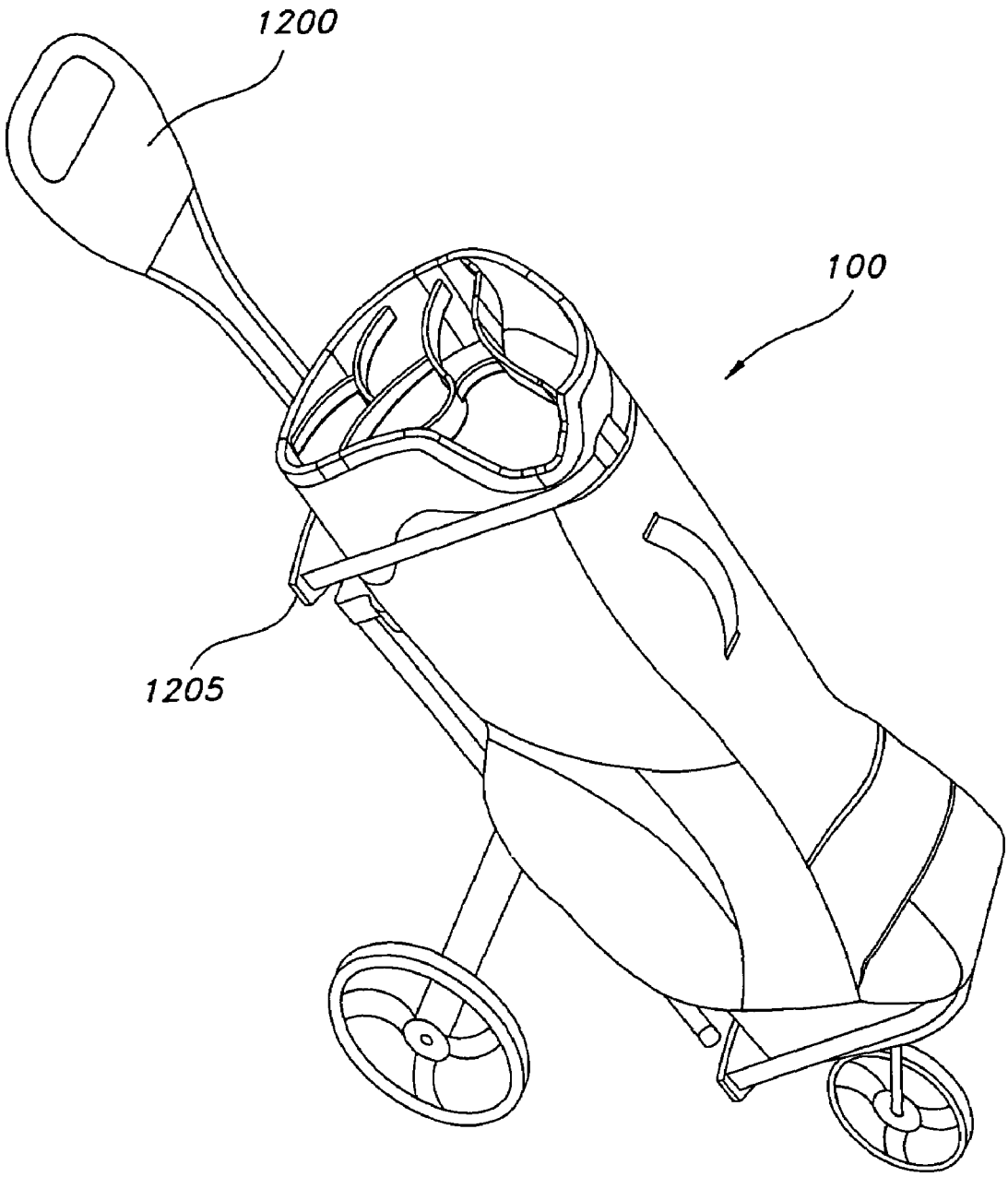
FIG. 12 is an illustration of a stand-type golf bag with the hybrid top cuff being used with a hand trolley in accordance with some embodiments of the present invention.
Figure 13:
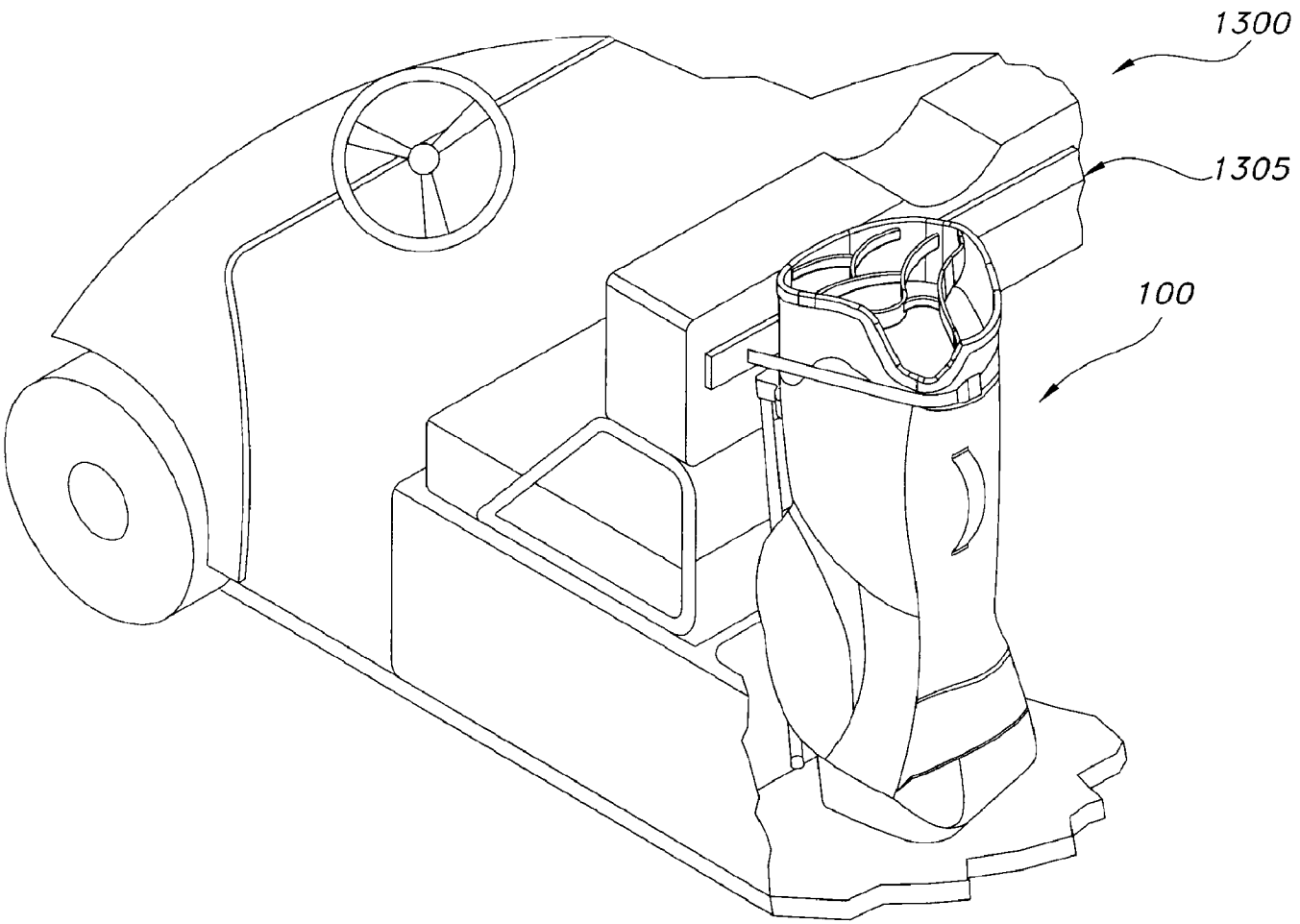
FIG. 13 is an illustration of a stand-type golf bag with the hybrid top cuff being used with a motorized golf cart in accordance with some embodiments of the present invention.

The exemplary embodiment of the present invention illustrated in FIG. 5, on the other hand, includes an elongated back portion of the outer collar 505, which positions the pivot mechanism approximately several inches lower than conventional carry bags. Providing a longer back portion 507 of the outer collar 505 allows the pivot mechanisms to be positioned several inches below the position of the pivot mechanisms on conventional carry bags. By lowering the position of the pivot mechanisms allows the top rest 1205 of a pull cart 1200, which is shown in FIG. 12 to fully support the golf bag 100. Similarly, lowering the pivot mechanism allows the top rest 1305 of a motorized cart 1300 to support the golf bag 100 on the outer collar at a point above the pivot mechanisms, as shown in FIG. 13. This allows the majority of the weight of the golf bag to be supported by the outer collar 505 as opposed to the pivot mechanisms, as in the riding cart, or on the retractable legs, as with a pull cart. Thus, the elongated back portion of the outer collar 505 allows the top cuff 110 allows a single bag to act as a "hybrid" golf bag, in that it may be used on both a motorized cart and a pull cart without damaging the retractable support legs. That is, the golf bag 120 may be used with a pull cart 1200, as shown in FIG. 12 or with a motorized cart 1300 as shown in FIG. 13 without damaging either the pivot mechanism for the retractable legs or the retractable legs.

Figure 6:
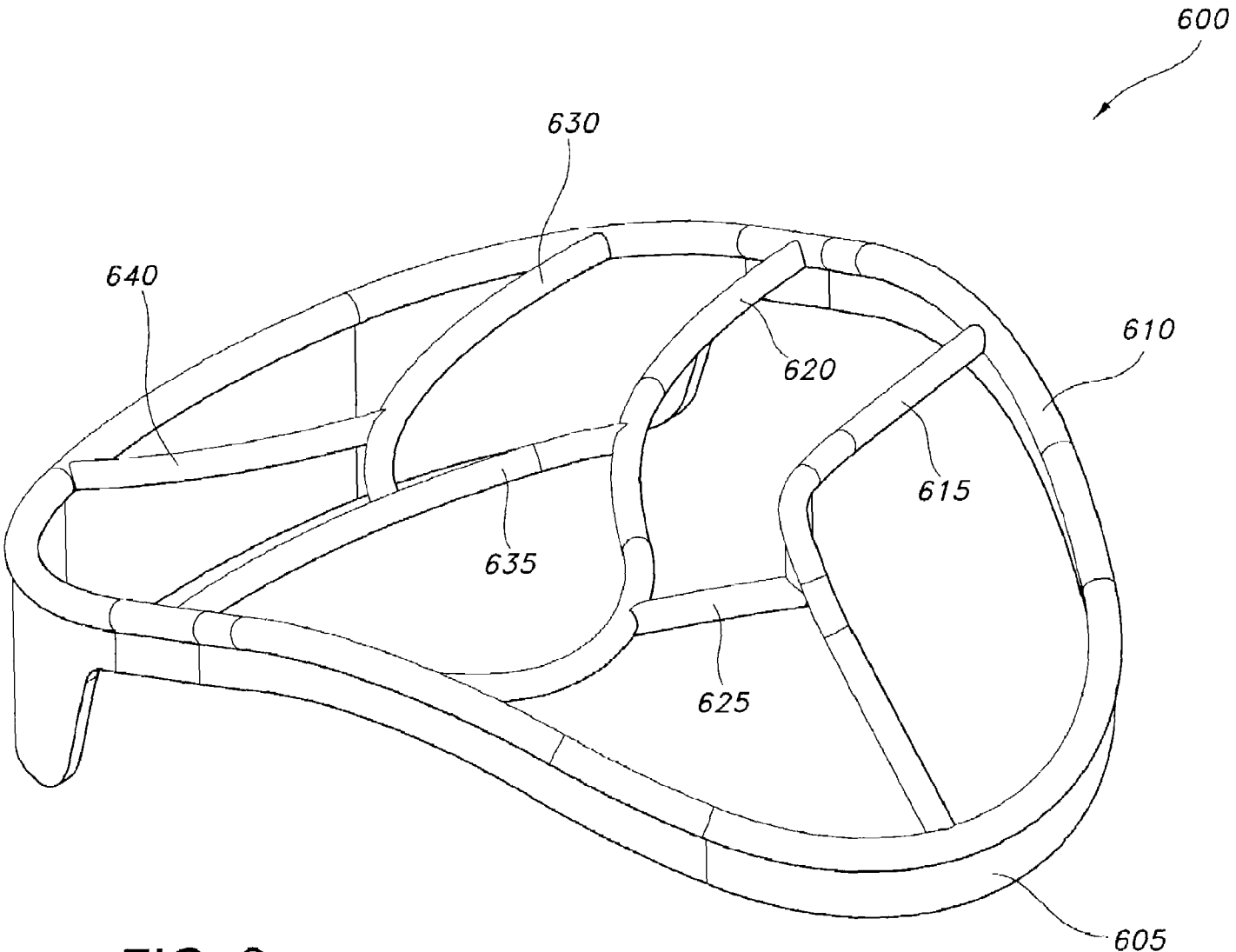
FIG. 6 is an illustration of an isometric view of a top cuff for use with a carry-type bag in accordance with another exemplary embodiment of the present invention.
Figure 7:
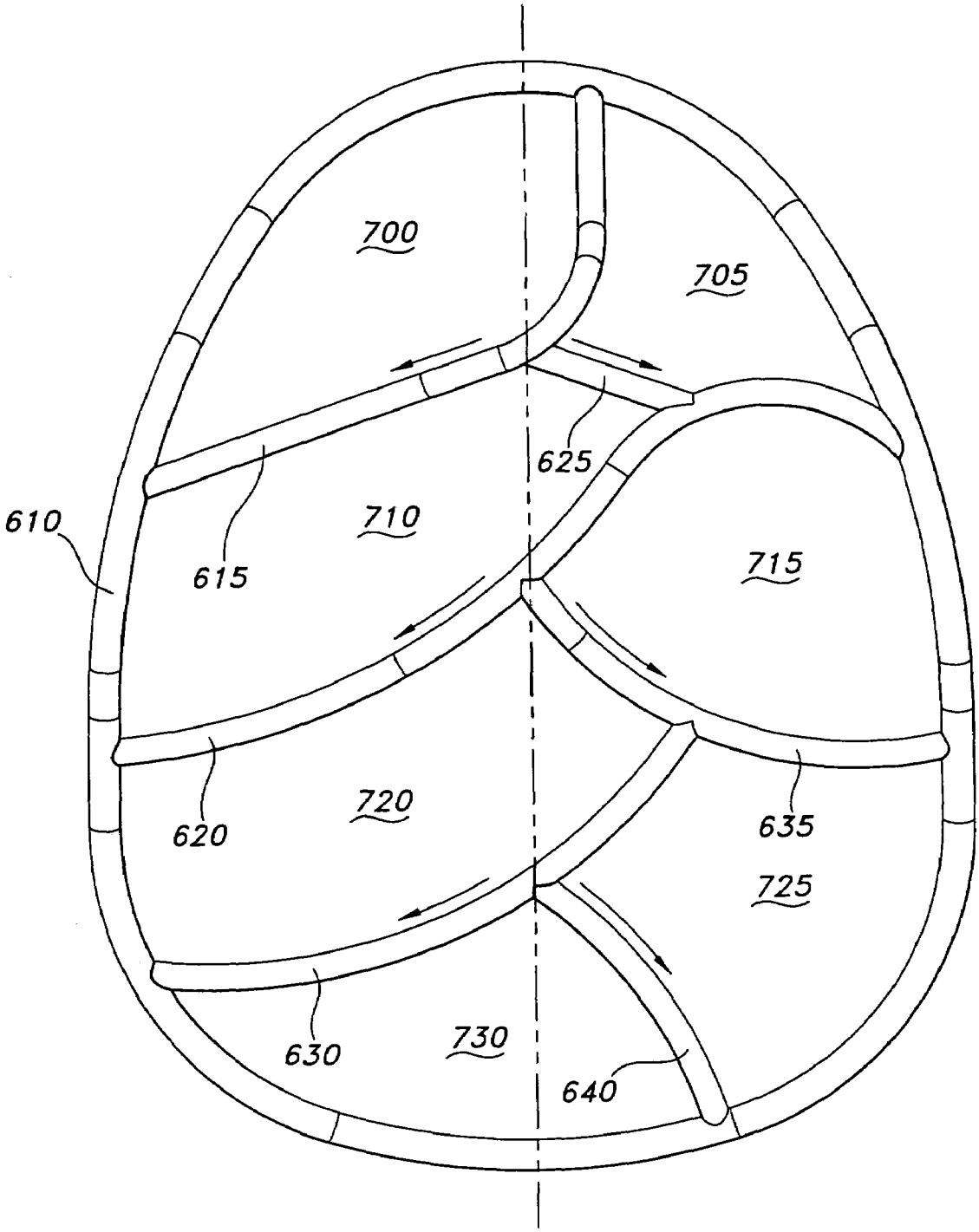
FIG. 7 is an illustration of a top view of a top cuff for use with a carry-type golf bag in accordance with another exemplary embodiment of the present invention.
Figure 8:
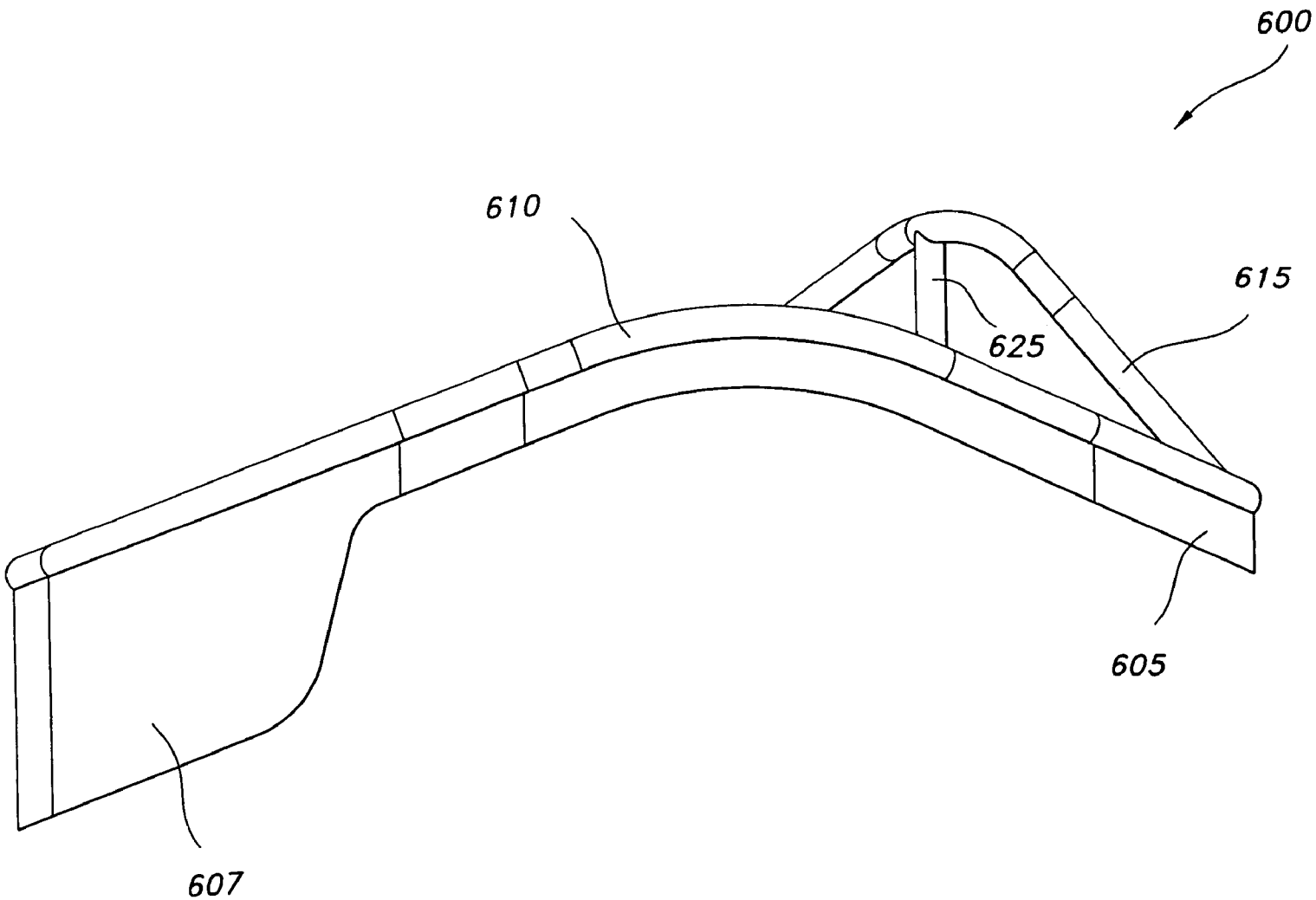
FIG. 8 is an illustration of a side view of a top cuff for use with a carry-type golf bag in accordance with another exemplary embodiment of the present invention.

FIGS. 6, 7, and 8 illustrate a second exemplary embodiment of the top cuff, which is much lighter than the top cuff 205 described above and is typically used for ultra-light carry-type bags, such as the AEROLITE® golf bag manufactured by the Mizuno Corporation of Osaka, Japan. FIG. 6 is an illustration of an isometric view of the top cuff 600 for use with an ultra-light carry-type bag. The top cuff 600 is virtually identical to the top cuff 205 of FIG. 2, with several modifications to reduce the overall weight. First, the first set of arcuate divider 615, 620, and 630 and the second set of arcuate dividers 625, 630, and 640, which are arranged in the same configuration as the dividers of the top cuff 110, as shown in FIG. 2, are formed from tubular dividers rather than wall-shaped dividers used in the top cuff 110. Secondly, the outer collar 605 of the top cuff 600 has a reduced front portion height as compared to the outer collar 205 of the top cuff 110. Although these changes reduce the overall weight of the top cuff 600, the top cuff provides substantial protection to the golf clubs stored in the compartments. FIG. 8, which is an illustration of a side view of a top cuff 600 for use with an ultra-light carry-type golf bag shows that the outer collar 605 and the top line 610 are angled upward to a peak, which lies intermediate between the front and rear of the top cuff 600. This configuration allows the lower compartments 715, 720, 725, and 730 (FIG. 7) to be easily accessible for inserting and removing shorter golf club. Golf clubs, such as metal woods, hybrid-type golf clubs and putters that may be stored in compartment 700 are protected from the remaining golf clubs by the first arcuate divider 615, which is raised above the level of the angled peak.

Figure 9:
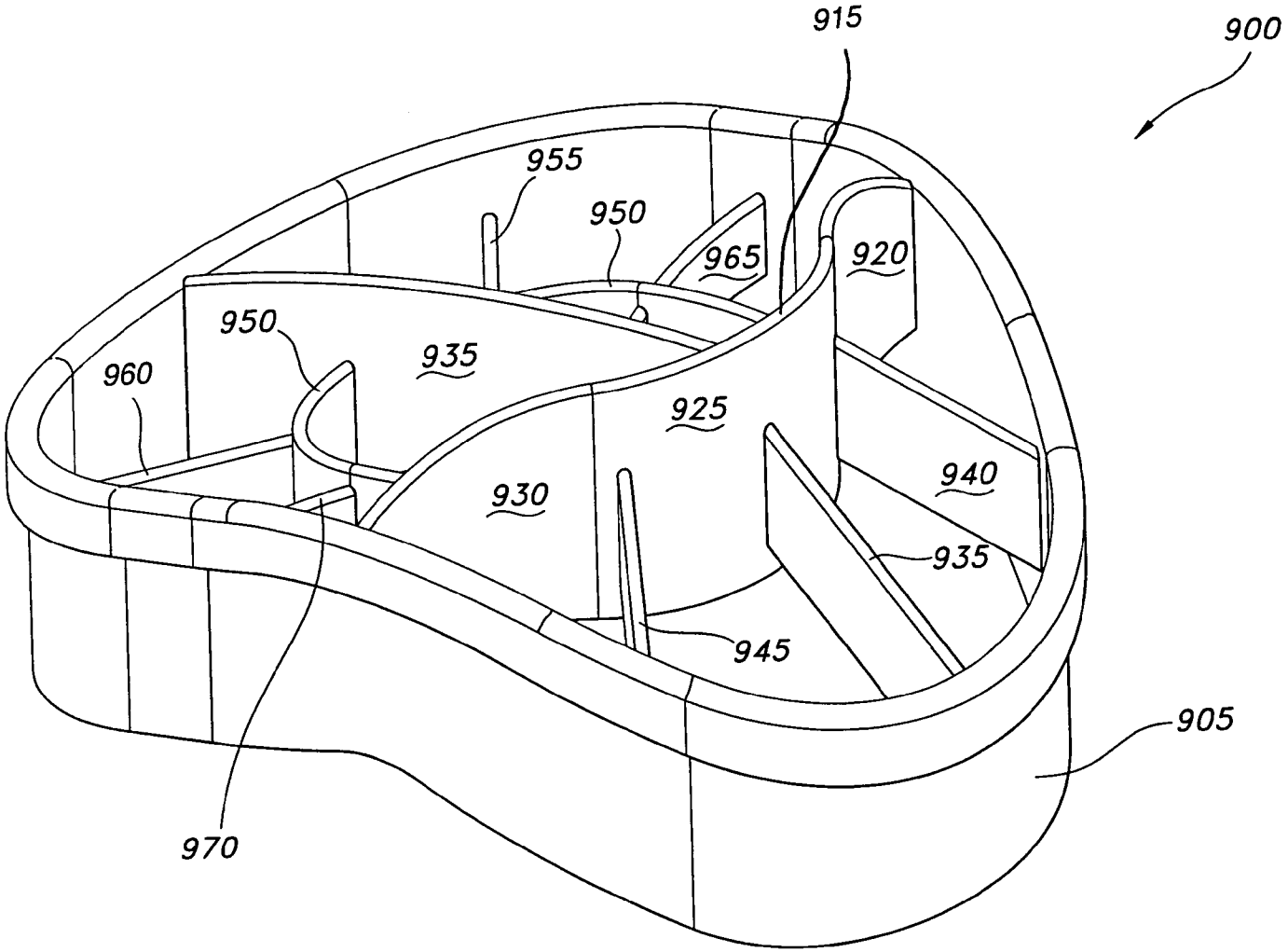
FIG. 9 is an illustration of an isometric view of a top cuff for use with a cart-type golf bag in accordance with another exemplary embodiment of the present invention.
Figure 10:
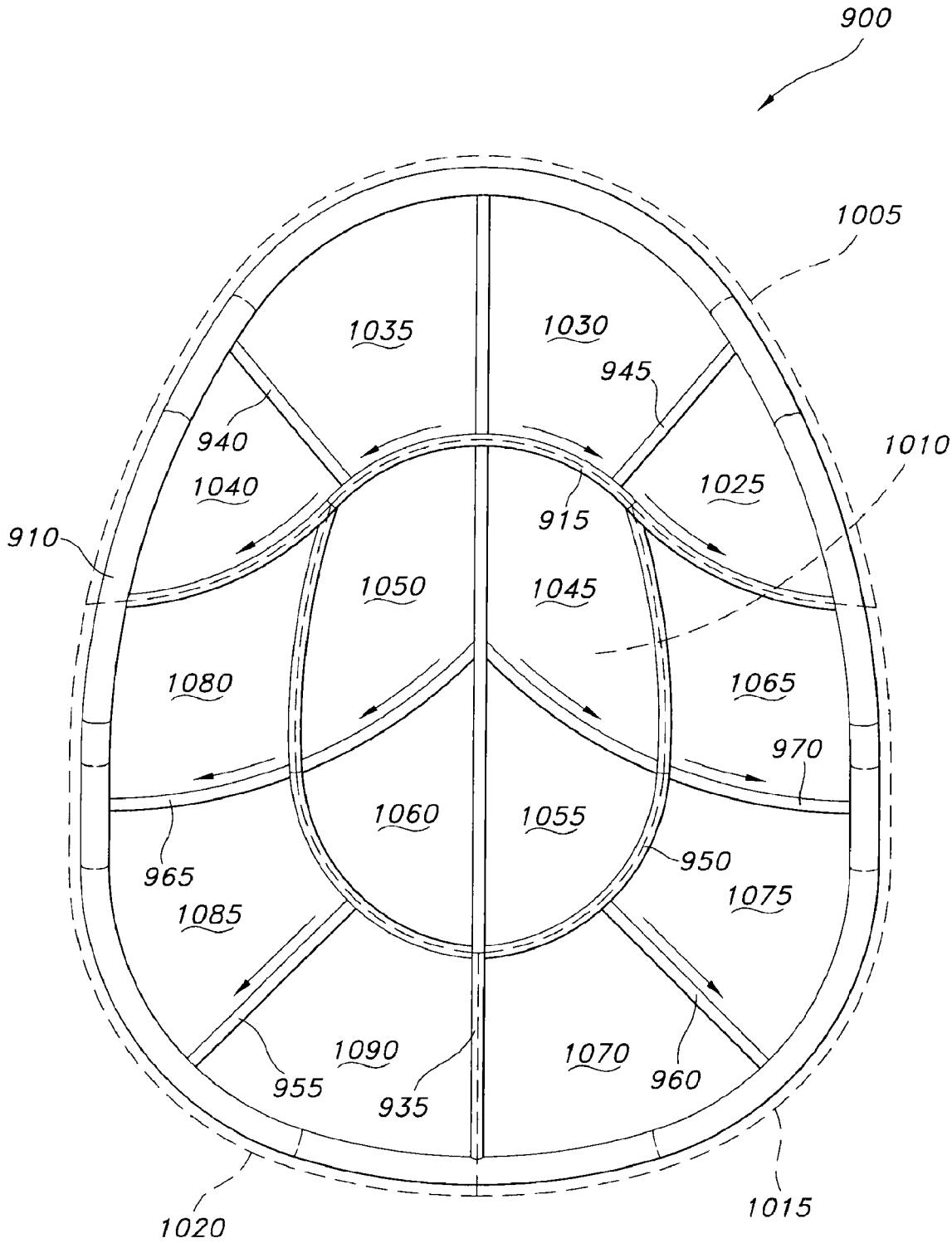
FIG. 10 is an illustration of a top view of a top cuff for use with a cart-type golf bag in accordance with another exemplary embodiment of the present invention.
Figure 11:
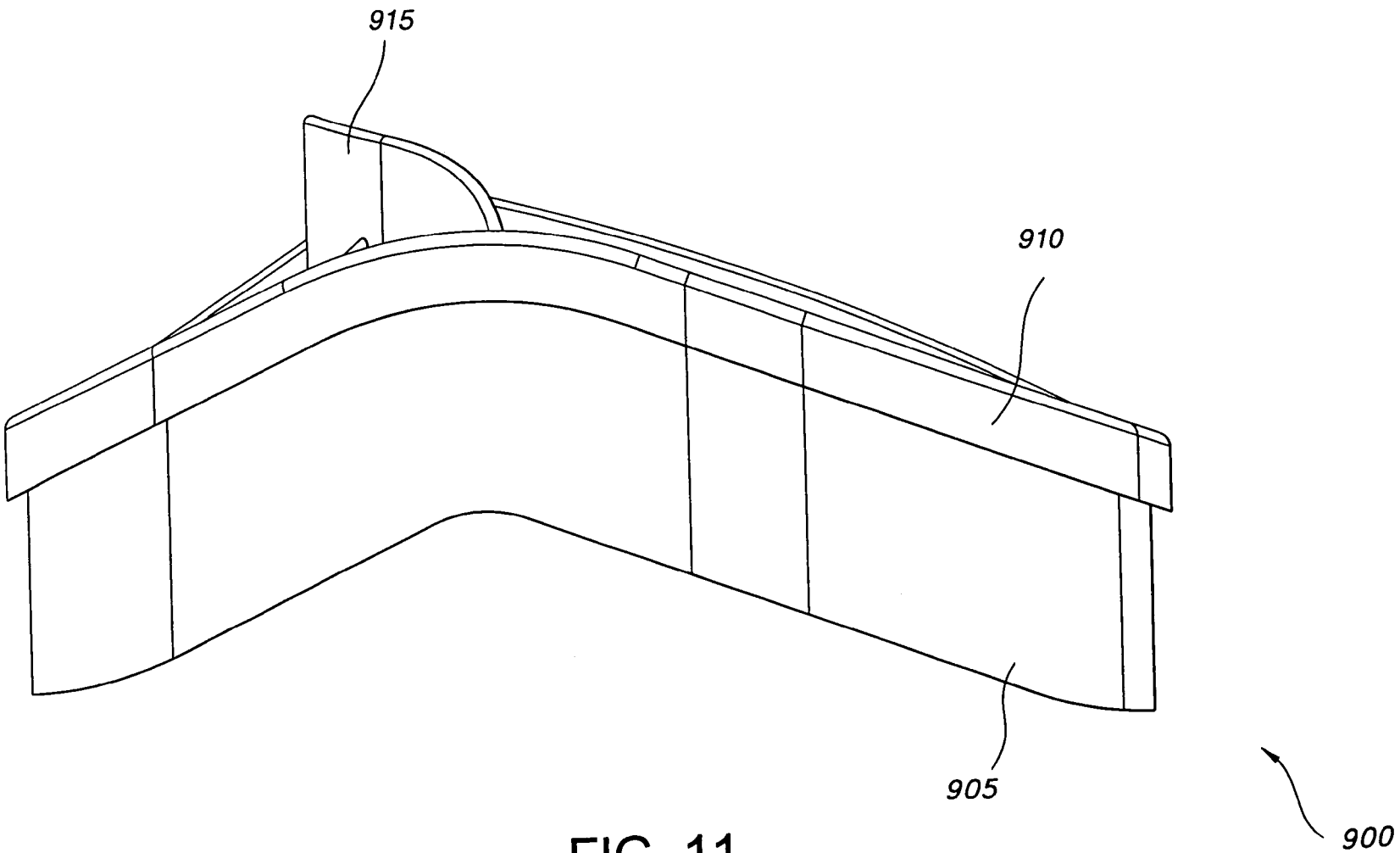
FIG. 11 is an illustration of a side view of a top cuff for use with a cart-type golf bag in accordance with another exemplary embodiment of the present invention.

FIGS. 9, 10, and 11 illustrate a top cuff for use with cart-type golf bags. The top cuff 900 is divided into fourteen separate compartments, each of which is designed to hold a single golf club. The top cuff 900 is designed with the same features as the top cuff 100 designed for the carry-type golf bag. Although the top cuff 900 is described as having fourteen separate compartments, those skilled in the art will appreciate that the number of compartments may vary without departing from the scope of the invention. For exampled, some golfers may carry less than the number of golf clubs allowed under the rules of golf. For instance, some golfers prefer to play golf with only eight, ten, twelve, or any number of golf clubs. The top cuff 900 may be made to have any number of compartments to meet the requirements of these golfers.

FIG. 9 is an illustration of an isometric view of a top cuff 900 for use with a cart-type golf bag in accordance with another exemplary embodiment of the present invention. The top cuff 900 includes a substantially circular outer collar 905 and a top edge 910. The top cuff 900 includes a central member 935, which bisects the top cuff 900 along a center line C/L and divides the top cuff into a first and second half. The top cuff 900 also includes a first arcuate divider 915, which is made from a plurality of smaller arcuate dividers and extends between the opposite sides of the outer collar 905. The first arcuate divider 915 contains a central arcuate section 925, which is generally convex downward in shape and a pair of arcuate end sections 920 and 930, which are generally convex upward in shape. The arcuate end section 920 has a first end connected to one side of the outer collar 905 and a second end connected to the central arcuate section 925. Similarly, the arcuate and section 930 has a first end connected to the opposite side of the outer collar 905 and a second end attached to the central arcuate section 925.

The top cuff 900 also includes a U-shaped member 950 centrally located within the top cuff 900 and having a first and second end that are connected to the first arcuate member 915 and, which bisects the central member 935. In one embodiment, the first and second ends of the U-shaped member 950 are attached to the first arcuate member 915 at the point where each of the two arcuate end members 920 and 930 join the central arcuate member 925.

The top cuff also includes a third arcuate member 965 and a fourth arcuate member 970, which in one exemplary embodiment are concaved upward. The third arcuate member 965 and the fourth arcuate member 970 each have a first end that is connected at an intermediate point on the central member 935. The third arcuate member 965 and the fourth arcuate member both slope in a generally downwardly direction bisecting the U-shaped member 950 and each have a second end that is attached to the outer collar 905.

The top cuff 900 also includes several straight members 940, 945, 955, and 960. The first straight member 940 is located intermediate the central member 935 and the first end arcuate member 920 and has a first end attached to the outer collar 905 and a second end attached proximate to the central arcuate member 925. The second straight member 945 is located intermediate the central member 935 and the second end arcuate member 930. It also has a first end attached to the outer collar 905 and a second end attached proximate to the central arcuate member 925. The first straight member 940 and the second straight member 945 lie on opposite sides of the central member 935 and are approximately mirror images of one another. Both are offset at an angle between 30 and 60 degrees from the vertical plane and preferably about 45 degrees from the vertical plane.

The third straight member 955 is located intermediate to the second arcuate member 965 and the central member 935 and the second arcuate member 965 and has a first end attached to the outer collar 905 and a second end attached the U-shaped member 950. The fourth straight member 960 is substantially the mirror image of the third straight member 955 and lies on the opposite side of the central member 935. The fourth straight member 960 is located intermediate the central member 935 and the third arcuate member 970 and has a first end attached to the outer collar 905 and a second end attached to the U-shaped member 950. Both the third straight member 955 and the fourth straight member 960 are offset at an angle between 30 and 60 degrees from the vertical plane and preferably about 45 degrees from the vertical plane.

FIG. 10 is an illustration of a top view of the top cuff 900 for use with a cart-type golf bag. The top cuff 910 includes the outer collar 905, which is symmetric about a center line (C/L) that extends vertically through the top cuff 900 and divides the top cuff 900 into a left-side portion and a right-side portion. The top cuff 900 may be divided into several sections, which include but are not limited to section 1005, 1010, 1015, and 1020. Section 1005 is formed by the intersection of the first arcuate member 915 and the outer collar 905 and is typically used to hold metal wood golf clubs, hybrid-type golf clubs, and/or a putter. The first section 1005 may further be divided into several smaller compartments to hold individual metal wood golf clubs, hybrid-type golf clubs, and/or a putter. For example, in one exemplary embodiment of the present invention, the first section 1005 may be subdivided by including a portion of the central member 935, and the first straight member 940 and the second straight member 945 to form four separate compartments 1025, 1030, 1035, and 1040.

The second section 1010 is defined by the intersection of the U-shaped member 950 and the first arcuate member 915 and contains four compartments 1045, 1050, 1055, and 1060. The third section 1015, which is bounded by a portion of the U-shaped member 950, the second arcuate end member 930, a portion of the outer collar 905 and the central member 935, contains compartments 1065, 1070, and 1075. The fourth section 1020 is forms the mirror image of the third section 1015. The fourth section 1020 is bounded by a portion of the U-shaped member 950, the first arcuate end member 920, a portion of the outer collar 905 and the central member 935, contains three compartments 1065, 1070, and 1075.

The advantage of the top cuff 900 is apparent from FIG. 10. The arcuate members form a framework of downwardly sloping dividers, which emanate from the central member 935. Therefore, when golf clubs are inserted into any of the compartments, 1025, 1030, 1035, 1040, 1045, 1050, 1055, 1060, 1065, 1070, 1075, 1080 1085, or 1090, the golf clubs will be directed along the members toward the outer collar 905 and away from the central portion of the top cuff 900, as indicated by the arrows. Since the golf clubs are directed away from the central portion of the top cuff 900, the distance between the golf clubs while stored in the golf bag 120 is maximized. Thus, the interaction between golf clubs, while stored in the golf bag 120 will be reduced, which minimizes the damage that may occur to the golf club heads and shafts due to the golf clubs coming in contact with one another.

FIG. 11 is an illustration of a side view of the top cuff 900 for use with a cart-type golf bag in accordance with some embodiments of the present invention. FIG. 11 is an illustration of a side view of the top cuff 900 in accordance with some embodiments of the present invention. The outer collar 905 and the top line 910 are angled upward to a peak, which lies intermediate between the front and rear of the top cuff 900. The angled peak provides several advantages. First, the compartments 1045, 1050, 1055, 1060, 1065, 1070, 1075, 1080, 1085, and 1090, lie below the level of the peak. This allows easy access to the shorter golf clubs, such as iron golf clubs and wedges, which are typically stored in these compartments. Secondly, by placing the access points of the rearward compartments 1045, 1050, 1055, 1060, 1065, 1070, 1075, 1080, 1085, and 1090 below the level of the peak insures that the golf club heads of the irons remain above the level of the top line 910. This allows the golf clubs to lay properly within the individual compartments 1045, 1050, 1055, 1060, 1065, 1070, 1075, 1080, 1085, and 1090 and are directed away from the central portion of the top cuff 900 thereby minimize contact with the other clubs and thus minimizing any damage to the golf clubs.

Referring still to FIG. 11, the first wave arcuate member 915, which defines the first section 1005 and contains compartment 1025, 1030, 1035, and 1040 has a height that lies above the peak of the top cuff 900. The additional height allows for increased protection to the longer golf clubs, such as metal woods, long putters, hybird golf clubs, and longer iron golf clubs, which as described above are typically stored in these compartments. The increased height of the first arcuate member 915 extends upward and is level or lies above the height of the iron golf clubs, which prevents the head portion of the shorter iron golf clubs from striking the golf shafts of the longer golf clubs stored in compartments 1025, 1030, 1035, and 1040.

Other alternative embodiments will become apparent to those skilled in the art to which an exemplary embodiment pertains without departing from its spirit and scope. Accordingly, the scope of the present invention is defined by the appended claims rather than the foregoing description.

We claim:

1. A top cuff for a golf bag, comprising:

an outer collar comprising a top edge, a sidewall, a top portion, a left portion, a right portion, and a bottom portion, the outer collar having a central axis passing through a point on the top portion and a point on the bottom portion;

a first plurality of arcuate dividers having a first and second end, wherein each of the first plurality of arcuate dividers extend in a downward angled direction, wherein at least one end of each of the first plurality of arcuate dividers is connected to the outer collar; and a second plurality of arcuate dividers having a first and second end, wherein the first end of each plurality of second arcuate dividers intersect the first plurality of arcuate dividers along the central axis and are angled in a downward direction opposite from the downward angled direction of the first plurality of arcuate dividers, wherein the downward angled direction is generally from the top portion towards the bottom portion and the left portion.

2. The top cuff of claim 1, wherein at least one of the first plurality of arcuate dividers has a height that extends above the top edge of the outer collar.

3. The top cuff of claim 1, wherein the outer collar comprises a depression located at a position on the outer collar offset from the central axis.

4. The top cuff of claim 3, wherein one of the second plurality of arcuate dividers intersects at one of the arcuate dividers from the first plurality of arcuate dividers at its first end and another of the arcuate dividers from the first plurality of arcuate dividers at its second end to form a compartment for holding a putter adjacent to the depression.

5. The top cuff of claim 1, wherein the outer collar is generally elliptical in shape.

6. A golf bag for receiving and holding golf clubs, including metal wood golf clubs, iron golf clubs, and a putter, the golf bag comprising:

a substantially elongated hollow body having an open end and a closed end;

a top cuff attached to the open end, the top cuff comprising:

an outer collar comprising a top edge, a sidewall, a top portion, a left portion, a right portion, and a bottom portion, the outer collar having a central axis passing through a point on the top portion and a point on the bottom portion;

a first plurality of arcuate dividers having a first and second end, wherein each of the first plurality of arcuate dividers extend in a downward angled direction, generally from the top portion towards the bottom portion and the left portion, wherein at least one end of each of the first plurality of arcuate dividers is attached to the outer collar; and a second plurality of arcuate dividers having a first and second end, wherein the first end of each plurality of second arcuate dividers intersect the first plurality of arcuate dividers along the central axis and are angled in a downward direction opposite from the downward angled direction of the first plurality of arcuate dividers.

7. The golf bag of claim 6, wherein at least one of the first plurality of arcuate dividers has a height that extends above the top edge of the outer collar.

8. The golf bag of claim 6, wherein the outer collar comprises a depression located at a position on the outer collar offset from the central axis and one of the second plurality of arcuate dividers intersects at least two arcuate dividers of the first plurality of arcuate dividers to form a compartment for holding a putter adjacent the depression.

9. The golf bag of claim 6, wherein the outer collar is generally elliptical in shape.

10. The golf bag of claim 6, wherein the outer collar is operable to receive a pair of pivot mechanisms for holding a pair of support legs.

11. The golf bag of claim 10, wherein the support legs are attached to a bottom section of the outer collar, such that an upper section of the outer collar rests against an upper support of a golf cart and the support legs are positioned below the upper support, when the golf bag is placed in the golf cart with the support legs in a closed position.

12. The golf bag of claim 11, wherein the golf cart comprises a hand trolley.

13. The golf bag of claim 11 wherein the golf cart comprises a motorized golf cart.

14. A top cuff for a golf bag for holding golf clubs, the top cuff comprising:

an outer collar comprising a top edge, a sidewall, a top portion, a left portion, a right portion, and a bottom portion, the outer collar having a central axis passing through a point on the top portion and a point on the bottom portion;

a central divider extending vertically along the central axis between the top portion of the outer collar and the bottom portion of the outer collar;

a first substantially convex arcuate divider oriented generally perpendicular to the central divider and extending between the left portion and the right portion of the outer collar;

a substantially U-shaped divider centrally located with in the outer collar, the substantially U-shaped divider having a first end connected to the first substantially convex arcuate divider at a first location and a second end connected the first substantially convex arcuate divider at a second location;

a pair of arcuate dividers angled in a downward direction and attached at a central location to the central divider and extending in opposite directions and intersecting the U-shaped divider and attaching to oppositely spaced surfaces of the sidewall of the outer collar; and a plurality of dividers extending radially between the U-shaped divider and the outer collar.

15. The top cuff of claim 14, wherein the first substantially convex arcuate divider comprises:

a first centrally located convex member extending between the first location and the second location;:

a first concave member extending from the first location to the outer collar; and a second concave member extending from the second location to the outer collar.

16. The top cuff of claim 15, wherein the first arcuate divider has a height extending above the top edge of the outer collar.

17. A golf bag for holding golf clubs comprising metal wood golf clubs, iron golf clubs, and a putter, the bag comprising:

an elongated body having a closed end and an open end;

a top collar attached to the open end operable for receiving golf clubs, the top collar comprising:

an outer collar comprising a top edge, a sidewall, a top portion, a left portion, a right portion, and a bottom portion, the outer collar having a central axis passing through a point on the top portion and a point on the bottom portion;

a central divider extending vertically along the central axis between the top portion of the outer collar and the bottom portion of the outer collar;

a first substantially convex arcuate divider oriented generally perpendicular to the central divider and extending between the left portion and the right portion of the outer collar;

a substantially U-shaped divider centrally located with in the outer collar, the substantially U-shaped divider having a first end connected to the first arcuate divider at a first location and a second end connected the first arcuate divider at a second location;

a pair of arcuate dividers angled in a downward direction and attached at a central location to the central divider extending in opposite directions and intersecting the U-shaped divider; and a plurality of dividers extending radially between the U-shaped divider and the outer collar.

* * * * *